US007228969B2

(12) United States Patent
Nakano

(10) Patent No.: US 7,228,969 B2
(45) Date of Patent: Jun. 12, 2007

(54) AIR-FILLED CUSHIONING MATERIAL

(75) Inventor: Katsumi Nakano, Kashiwara (JP)

(73) Assignee: Kashiwara Seitai Co., Ltd., Osaka (JP)

( * ) Notice: Subject to any disclaimer, the term of this patent is extended or adjusted under 35 U.S.C. 154(b) by 442 days.

(21) Appl. No.: 10/810,569

(22) Filed: Mar. 29, 2004

(65) Prior Publication Data

US 2004/0211697 A1 Oct. 28, 2004

(30) Foreign Application Priority Data

Apr. 24, 2003 (JP) ..... 2003-119146

(51) Int. Cl.
*B65D 30/00* (2006.01)
*B65D 81/02* (2006.01)

(52) U.S. Cl. ..... 206/522; 383/3; 383/66

(58) Field of Classification Search ..... 206/522, 206/521; 383/3, 66, 87, 37
See application file for complete search history.

(56) References Cited

U.S. PATENT DOCUMENTS 4,528,694 A * 7/1985 Skovgaard ..... 383/10
5,427,830 A * 6/1995 Pharo ..... 428/35.2
5,826,723 A * 10/1998 Jaszai ..... 206/522
5,857,571 A * 1/1999 Tschantz et al. ..... 206/522
6,334,537 B1 * 1/2002 Tepper ..... 206/522
6,629,777 B2 * 10/2003 Tanaka et al. ..... 383/3

FOREIGN PATENT DOCUMENTS

JP 7-285581 A 10/1995

* cited by examiner

*Primary Examiner*—Jila M. Mohandesi
(74) *Attorney, Agent, or Firm*—Birch, Stewart, Kolasch & Birch, LLP

(57) ABSTRACT

It is an air-filled cushioning material which sufficiently protects an article to be protected with less possibility of rupture of sheets against an external force to a compartment thereof or wild bounding in falling. The air-filled cushioning material 1 formed of non-breathable soft resin sheets has a compartment area 2 that produces cushioning effect by filling it with air. The compartment area 2 is separated into a first compartment 21 and an adjacent second compartment 22, both compartments 21, 22 communicating with each other via an air-flow passage 7. The air-flow passage 7 allows an air-flow to pass from either of the compartments 21, 22 to the other while applying resistance. The air moves from either of the compartments 21, 22 which accepts an external force P to the other through the air-flow passage 7.

7 Claims, 6 Drawing Sheets

AIR-FILLED CUSHIONING MATERIAL

This Nonprovisional application claims priority under 35 U.S.C. § 119(a) on Patent Application No(s). 2003-119146 filed in JAPAN on Apr. 24, 2003, the entire contents of which are hereby incorporated by reference.

FIELD OF THE INVENTION

The present invention relates to an air-filled cushioning material for packaging an article to be protected so as to prevent it from damage.

BACKGROUND OF THE INVENTION

Hitherto, an air-filled cushioning material with an air layer between overlying soft resin sheets has been widely used. This intends to protect the packaged article from an external impact by fitting the air layer to the whole or a part of the article.

An example of such air-filled cushioning material has been already proposed by the present applicant as an air-filled cushioning material 101, which is shown in FIG. 6, in Japanese Laid Open Patent Application No. H07-285581. In FIG. 6, a compartment 102 formed by adhering the non-breathable soft resin sheets, will be filled with air in order to protect the article in contact with the air-filled cushioning material 101 by cushioning effect of the inflated compartments 102.

However, when one of the compartments 102 accepts a strong external force of impact or the like concentrated thereon, the article that especially weighs heavy may get damaged.

Each compartment 102 is a closed portion, and if the air in the compartment 102 moves responding to the external force, there is no way out for the air. Trying to absorb the impact, the sheet has a limit on strength. When the external force excesses the limit of the sheet, the compartment 102 ruptures.

Even when the compartment 102 does not rupture in falling on the floor or ground, wild bounding may cause damage to the article in contact with the compartment area 102.

BRIEF SUMMARY OF THE INVENTION

Accordingly, in view of the above-described deficiencies, it is an object of the present invention to provide an air-filled cushioning material which sufficiently protects an article to be protected with less possibility of rupture of compartments against a strong external force or wild bounding in falling.

A first aspect of the present invention as set forth in claim 1 provides an air-filled cushioning material which is formed by sealing part of non-breathable soft resin sheets and has a compartment area 2 that produces cushioning effect by filling with air thereinside. In the air-filled cushioning material 1, the compartment area 2 is separated into a first compartment 21 and an adjacent second compartment 22, and both compartments 21, 22 communicate with each other via an air-flow passage 7. The air-flow passage 7 allows an air-flow to pass from either of the compartments 21, 22 to the other while applying resistance. The air moves through the air-flow passage 7 from either of the compartments 21, 22 which accepts an external force P to the other.

A second aspect of the present invention as set forth in claim 2 provides an air-filled cushioning material as cubiform cushioning material 8 having a space 81 for containing an article A to be protected, the space being formed by folding and sealing part of a flat cushioning material 1. The flat cushioning material 1 is formed by sealing part of non-breathable soft resin sheets and has a compartment area 2 that produces cushioning effect by filling with air thereinside. In the cubiform cushioning material 8, the compartment area 2 is separated into a first compartment 21 and an adjacent second compartment 22, and both compartments 21, 22 communicate with each other via an air-flow passage 7. The air-flow passage 7 allows an air-flow to pass from either of the compartments 21, 22 to the other while applying resistance. The air moves through the air-flow passage 7 from either of the compartments 21, 22 which accepts an external force P to the other, whereby the article is protected.

A third aspect of the present invention as set forth in claim 3 provides the air-filled cushioning material as defined in claim 1 or 2, wherein the air-flow passage 7 is composed of a first air-flow passage 7*r* and a second air-flow passage 71 disposed parallel to each other. The first air-flow passage 7*r* is formed in order that resistance to the passing air-flow from the second compartment 22 to the first compartment 21 may be larger than that from the first compartment 21 to the second compartment 22. The second air-flow passage 71 is formed in order that resistance to the passing air-flow from the first compartment 21 to the second compartment 22 may be larger than that to the air-flow from the second compartment 22 to the first compartment 21.

A fourth aspect of the present invention as set forth in claim 4 provides the air-filled cushioning material as defined in claim 3, wherein the air-flow passage 7 is a check valve.

A fifth aspect of the present invention as set forth in claim 5 provides an air-filled cushioning material which is formed by sealing part of non-breathable soft resin sheets, comprising a first compartment 21 that produces cushioning effect by filling with air thereinside, a second compartment 22, being same as the first compartment 21, that is adjacent to the first compartment 21 and communicates with it directly or indirectly, an air inlet portion 5 for passing air to fill in the compartments 21, 22, an inlet side check valve 6 for preventing the air filled in the compartments 21, 22 from leaking out of the air-filled cushioning material, and a cushion check valve 7 disposed where the first compartment 21 and the second compartment 22 communicate in order to pass the air-flow from either of the compartments 21, 22 to the other while applying resistance.

A sixth aspect of the invention as set forth in claim 6 provides the air-filled cushioning material defined as claim 5, wherein the air inlet portion 5, the first compartment 21 and the second compartment 22 are sequentially and adjacently disposed to each other, and the inlet side check valve 6 is provided at the boundary of the air inlet portion 5 and the first compartment 21, and the cushion check valve 7 is provided at the boundary of the first compartment 21 and the second compartment 22.

A seventh aspect of the present invention as set forth in claim 7 provides the air-filled cushioning material as defined in claim 5, wherein the first compartment 21, the air inlet portion 5 and the second compartment 22 are sequentially and adjacently disposed to each other, and the inlet side check valve 6 is provided at the boundary of the air inlet portion 5 and the outside of the air-filled cushioning material 1, and the cushion check valves 7 are provided at the boundary of the air inlet portion 5 and the first compartment 21, and at the boundary of the air inlet portion 5 and the second compartment 22.

In the aspects of the present invention as defined in each claim above, when either of the compartments 21, 22 accepts an external force P, the air in the compartment can move into one of the other compartments 21, 22 through the air-flow passage 7, thereby avoiding rupture of the compartments 21, 22 or damage of the article A in contact with the compartment area 2 due to wild bounding in falling on the floor or ground.

In the aspect of the present invention as defined in claim 2, a cubiform cushioning material 8 is formed to have a containing space thereinside, and an article A in the space 81 can be protected effectively.

In the aspects of the present invention as defined in claims 3 and 4, the first air-flow passage (check valve) 7*r* is formed in order that resistance to the passing air-flow from the second compartment 22 to the first compartment 21 may be larger than that from the first compartment 21 to the second compartment 22, while the second air-flow passage (check valve) 71 is formed in order that resistance of the passing air-flow from the first compartment 21 to the second compartment 22 may be larger than that from the second compartment 22 to the first compartment 21. Since the air passes with resistance through the cushion check valve 7, as compared with the case where a portion between the compartments 21 and 22 is fully open, the air in the compartment will not move so quickly and direct hitting of the article A on the floor or ground will not happen, resulting in no damage to the article A. Meanwhile, it is effective for a compartment 2 which accepts an impact to prevent it-from rupture which would happen by reason that there is no way out for the air in the compartment. And the article A may avoid damage due to wild bounding on the floor or ground.

In the aspects of the present invention as defined in claims 5 to 7, the compartments 21, 22 can be effectively filled with air through the air inlet portion 5.

BRIEF DESCRIPTION OF THE DRAWINGS

The present invention will become more fully understood from the detailed description given hereinbelow and the accompanying drawings, which are given by way of illustration only, and thus are not limitative of the present invention.

FIG. 4(A) shows a state containing an article to be protected, and FIG. 4(B) a state falling on the floor or ground from the state in FIG. 4(A).

DETAILED DESCRIPTION OF THE PREFERRED EMBODIMENTS

Figure 1:
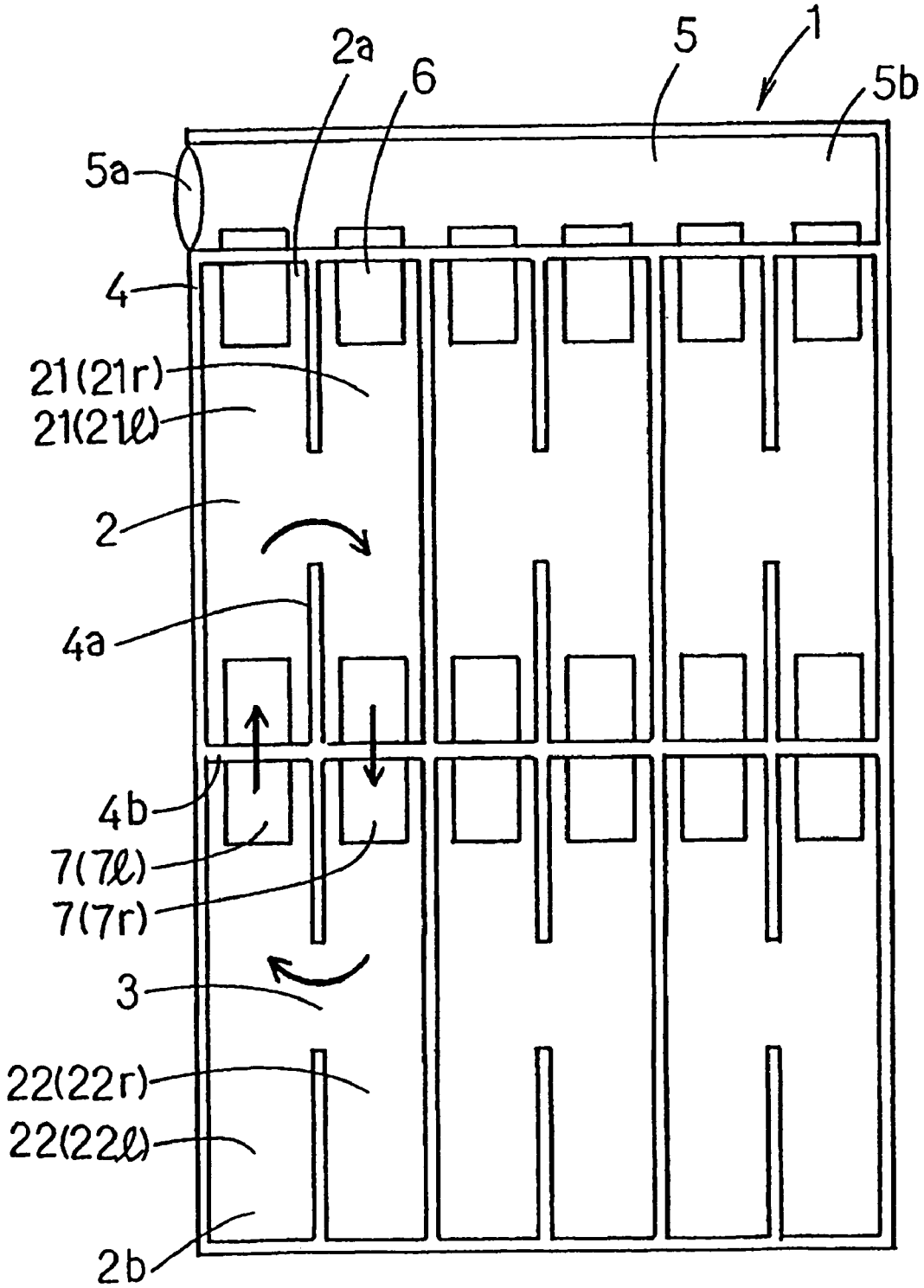
FIG. 1 is a plan view showing an air-filled cushioning material (flat cushioning material) in an embodiment of the present invention.
Figure 3:
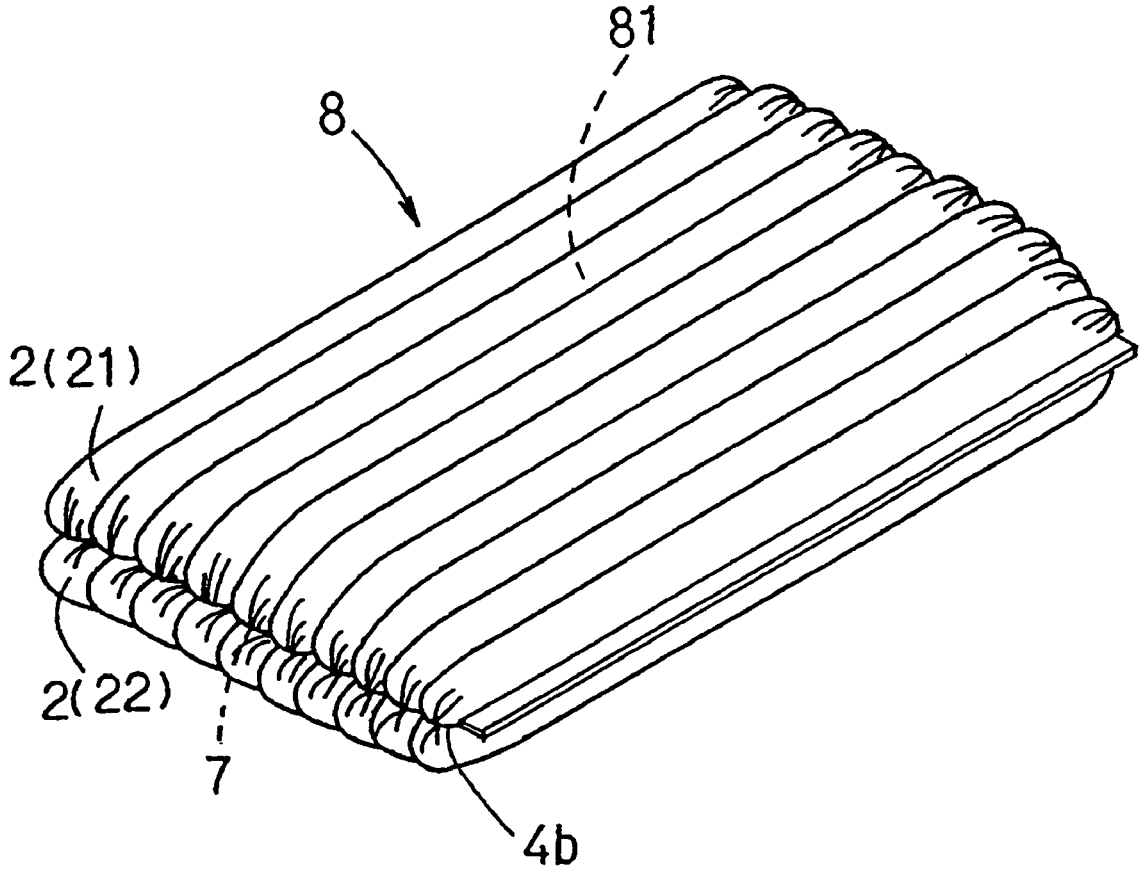
FIG. 3 is a perspective explanatory view showing an air-filled cushioning material (cubiform cushioning material) in the embodiment.
Figure 4:
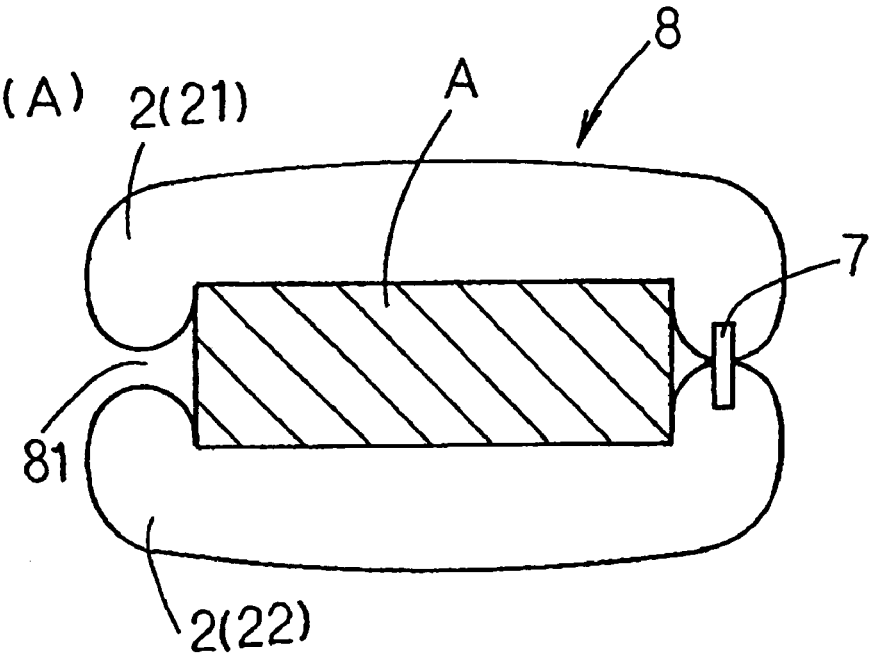
FIG. 4 is a sectional explanatory view showing a state of use of the air-filled cushioning material (cubiform cushioning material) in the embodiment.
Figure 4:
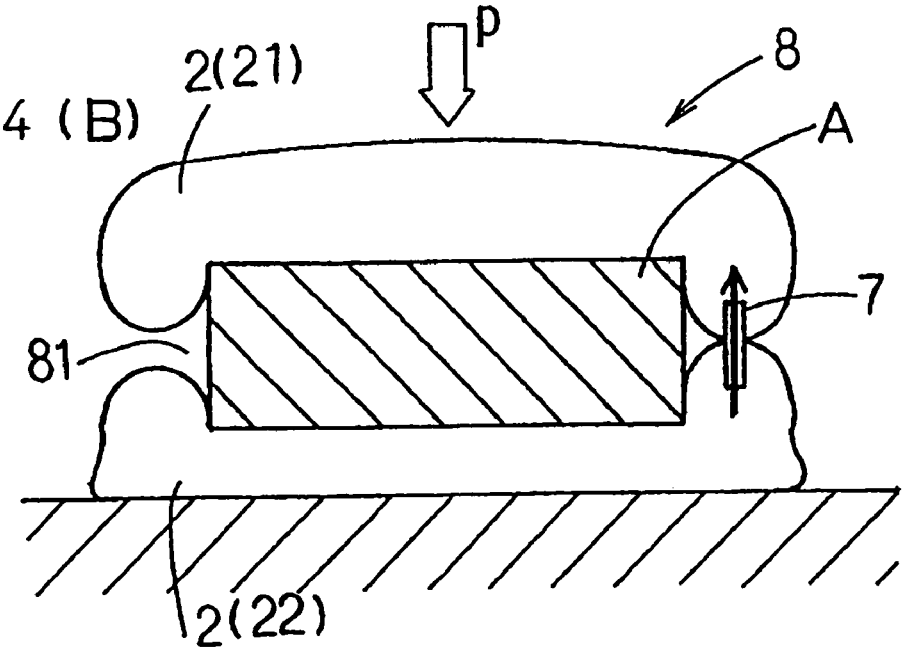
Figure 5:
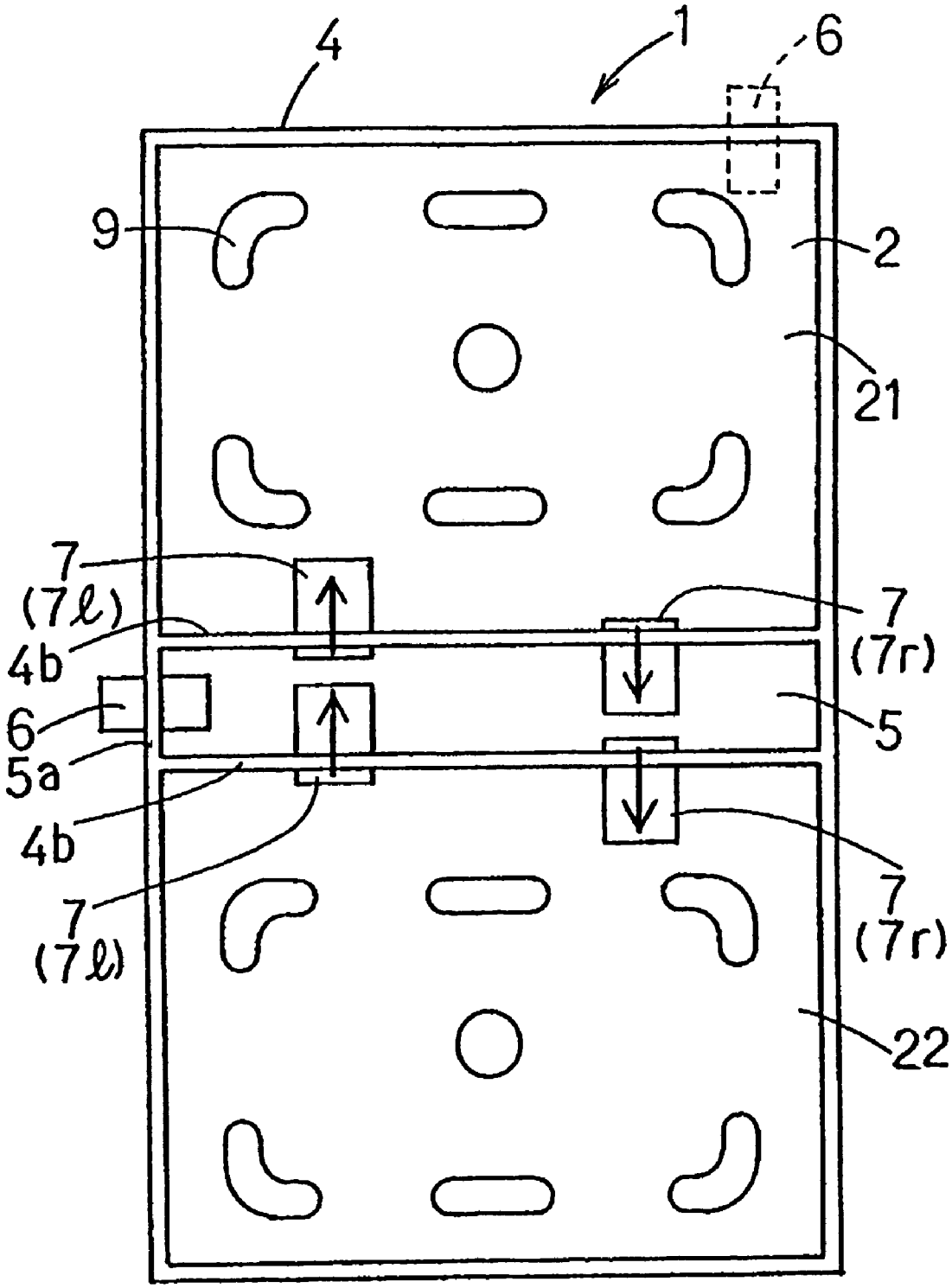
FIG. 5 is a plan view of an air-filled cushioning material (flat cushioning material) in other example of the embodiment.
Figure 6:
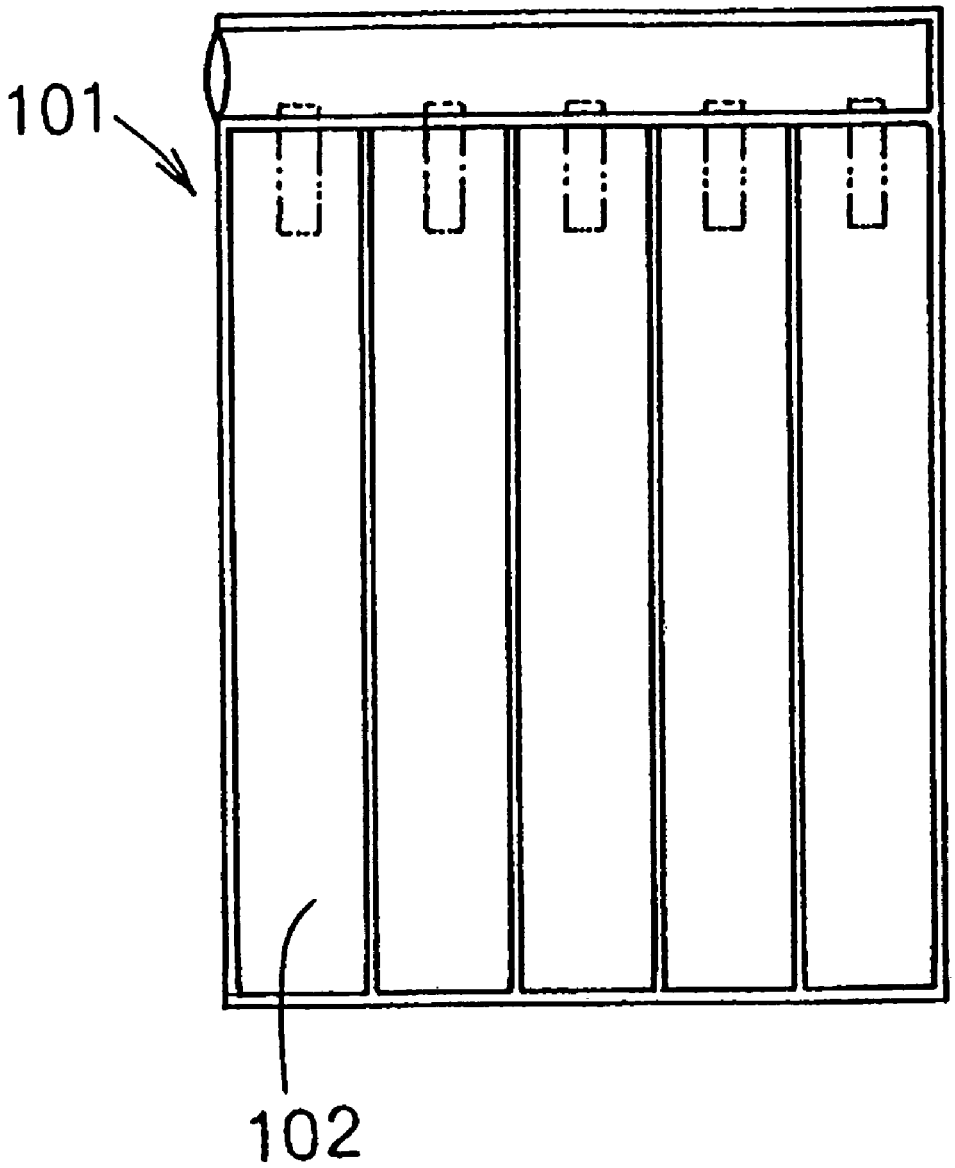
FIG 6 PRIOR ART
FIG. 6 is a plan view showing an example of a conventional air-filled cushioning material

FIG. 1 is a plan view showing an air-filled cushioning material (flat cushioning material) in this embodiment. FIG. 3 is a perspective explanatory view showing an air-filled cushioning material (cubiform cushioning material) in the embodiment. FIG. 4 is a sectional explanatory view showing a state of use of the air-filled cushioning material (cubiform cushioning material) in the embodiment. FIG. 5 is a plan view of an air-filled cushioning material (flat cushioning material) in other example of embodiment.

In the following explanation, the expression of upper, lower, right or left refers to the relative direction when the air-filled cushioning material (flat cushioning material) is disposed as shown in FIG. 1.

The air-filled cushioning material of the present invention is made of a non-breathable soft resin sheet. In this embodiment, two rectangular polyethylene sheets (of an identical shape) are used. The overlying sheets are partially bonded together by a seal 4 provided at plural positions by thermal compression or the like, whereby a plurality of compartments 2 are formed parallel in the lateral direction, and an air inlet portion 5 communicating with these compartments 2 is formed above them, thus a flat air-filled cushioning material 1 as shown in FIG. 1 is completed.

The air-filled cushioning material 1 here is formed with two sheets, but it may be formed by folding one sheet or by other means.

The compartments 21, 22, seeming like strips extending in the vertical direction, are adjacently formed in the lateral direction.

In one compartment, a lateral partition seal 4*a* and a vertical partition seal 4*b* are provided to divide into upper, lower, right and left portions, that is, a first left compartment 21*l*, a first right compartment 21*r*, a second left compartment 21*l*, and a second right compartment 22*r*, respectively.

The lateral partition seal 4*a* has an omitted portion in the middle, and this omitted portion is a communicating portion 3. Through this communicating portion 3, the first left compartment 21*l* and the first right compartment 21*r*, and the second left compartment 22*l* and the second right compartment 22*r* communicate with each other.

The present invention is not limited to this mode. For example, without a lateral partition seal 4*a*, a first compartment 21 where a first left compartment 21*l* is integrated with a first right compartment 21*r*, and a second compartment 22 where a second left compartment 22*l* is integrated with a second right compartment 22*r* may be respectively formed.

Also, a first compartment 21 and a second compartment 22, as shown in FIG. 5, may be respectively formed as one portion. Not illustrated, though, a plurality of what FIG. 5 shows may be continuously formed in the lateral direction.

In the compartment 2, the upper ends of the first left compartment 21*l* and the first right compartment 21*r* are not closed as an open end 2*a*. The lower ends of the second left compartment 22*l* and the second right compartment 22*r* are closed. In this embodiment, at the open end 2*a* is provided an inlet side check valve 6, through which the first left compartment 21*l* and the first right compartment 21*r* respectively communicate with an air inlet portion 5 mentioned later.

In the case as described above that the compartment where a first left compartment 21*l* is integrated with a first right compartment 21*r*, and the compartment where a second left compartment 22*l* is integrated with a second right compartment 22*r*, are respectively formed without a lateral partition seal 4*a*, one inlet side check valve 6 may be provided with the integrated first compartment 21. Or, as shown in FIG. 5, without providing respective inlet side check valve 6 with the compartments 21, 22, one inlet side check valve 6 may be provided at one end 5*a* of the air inlet portion 5.

The air inlet portion 5 is positioned above the first compartments 21, and is a passage formed in the lateral direction so as to be at right angles to the compartments 21, 22. The left end of the air inlet portion 5 is open as an open end 5*a*, while the right end 5*b* thereof is closed. This open end 5*a* is an inlet for air into the compartments 2.

In other words, the compartments 2 are formed so as to branch off from one side of the air inlet portion 5, and are filled with air from the open end 5*a* along the air inlet portion 5. The way to feed air into the compartments 2 through the air inlet portion 5 leads to effective filling of the air.

Instead of the present embodiment where the compartments 21, 22 are filled with air through the air inlet portion 5, air can be directly fed into the compartments 21, 22 from outside.

Further, as shown in FIG. 5, the air inlet portion 5 may be interposed between the first compartment 21 and the second compartment 22. That is, the first compartment 21 is disposed adjacently to one side of the air inlet portion 5, and the second compartment 22 is disposed at the other side thereof.

FIG. 2 exemplifies an inlet side check valve 6 used in this embodiment. It is made of a small piece of soft resin sheet with both ends being open in a flat tubular shape, and allows an air-flow from one end thereof to the other, i.e. the air-flow F from the air inlet portion 5 to the first compartment in this example, and checks the air-flow in the reverse direction.

Figure 2A:
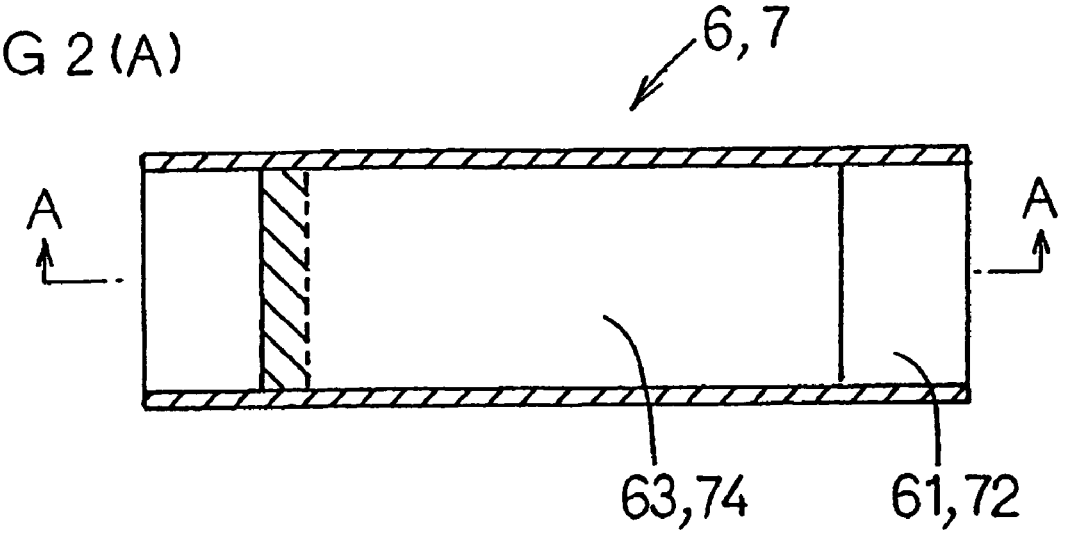
FIG. 2(A) is a plan view showing a check valve using a valve disk, FIG. 2(B) a sectional view A—A in FIG. 2(A), and FIG. 2(C) a plan view showing a check valve forming a partial seal.
Figure 2B:
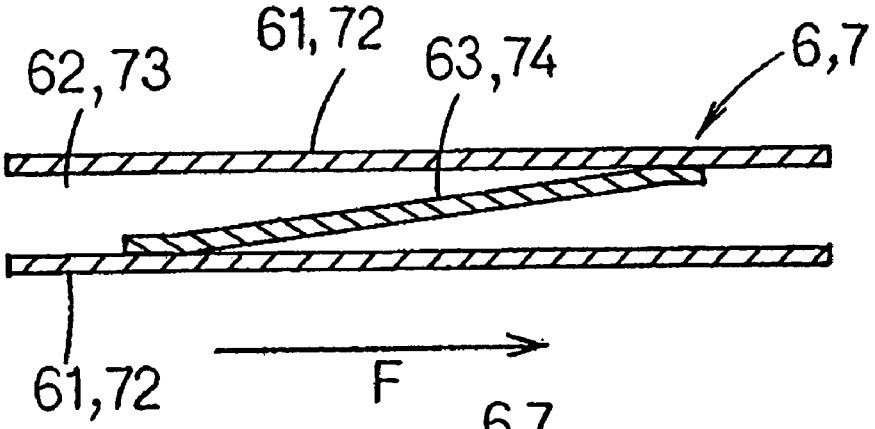
FIG. 2 is a diagram showing an application example of check valve in the present invention.
Figure 2C:
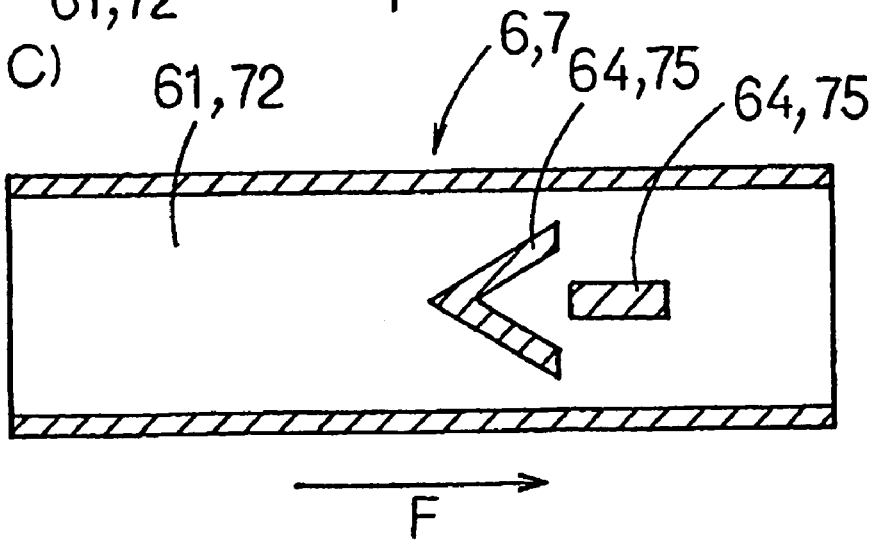

In the inlet side check valve 6, as shown in FIGS. 2(A) and 2(B), a valve air passage 62 between the two passage sheets 61, 61 can be checked by a valve sheet 63 which is adhered to one of the passage sheets 61, 61 on one side and movable on the other side. Or, as shown in FIG. 2(C), the passage sheets 61, 61 are adhered by a spot seal 64 producing in the valve air passage 62 resistance that is, as compared with the air-flow F in the direction of an arrow, set larger against the passing air-flow in the reverse direction, thus the air-flow F may pass more smoothly. The inlet side check valve 6 is not limited to these examples, but may employ various forms.

The inlet side check valve 6 is provided in each compartment 2 in this embodiment. In case one of the compartments 2 ruptures, only the air in the ruptured compartment 2 escapes. Accordingly, this incident does not affect other compartments 2, maintaining cushioning effect in the air-filled cushioning material 1.

Feeding of air into the compartment area 2 of the air-filled cushioning material 1 in such a structure, for example, can be achieved by a pipe or something like that which is inserted into the open end 5*a* of the air inlet portion 5. The air supplied through the air inlet portion 5 flows into the compartment area 2 and reaches the respective compartments 21, 21 via the inlet side check valve 6. Since the inlet side check valve 6 is provided at each compartment 2 in this embodiment, the air filled in the compartments 2 may be checked, remaining inflated.

In the present invention, the inlet side check valve 6 is not indispensable, but may be carried out in other way. For example, the inlet side check valve 6 may be provided at either the first left compartment 21*l* or the first right compartment 21*r*. As shown in FIG. 5, it may be formed only at the open end 5*a* of the air inlet portion 5. Or, without providing an inlet side check valve 6, the open end 2*a* of the compartment 2 or the open end 5*a* of the air inlet portion 5 may be closed by thermal compression, plug or other means, maintaining the inflated state, after the air is filled in the compartment area 2.

In this embodiment, a cushion check valve 7 as an air-flow passage is respectively provided between the first left compartment 21*l* and the second left compartment 22*l*, and between the first right compartment 21*r* and the second right compartment 22*r*. Through the cushion check valve 7, the first left compartment 21*l* and the second left compartment 22*l*, and the first right compartment 21*r* and the second right compartment 22*r* respectively communicate with each other.

In other embodiment shown in FIG. 5, the air inlet portion 5 is positioned between the first compartment 21 and the second compartment 22.In this example, the cushion check valve 7 is provided at the boundary of the air inlet portion 5 and the first compartment 21, and at the boundary of the air inlet portion 5 and the second compartment 22.

This air-flow passage allows an air-flow to pass with resistance from either side to other side between the first compartment 21 and the second compartment 22. The cushion check valve 7 of this embodiment is composed of a set of the left side check valve 71 and the right side check valve 7*r*. The left side check valve 71 allows an air-flow, as indicated by an arrow, to pass from the second left compartment 22*l* to the first left compartment 21*l*, and checks an air-flow in the reverse direction. The right side check valve 7*r* allows an air-flow to pass from the first right compartment 21*r* to the second right compartment 22*r*, and checks an air-flow in the reverse direction.

In a different example in FIG. 5, the function of the air-flow passage is same as above, but each of the left side check valve 71 and the right side check valve 7*r* are respectively provided as a set of two pieces in a manner that they are divided by the air inlet portion 5. Thus, the air passing the check valves 71, 7*r* flows via the air inlet portion 5.

The air-flow passage of the present invention is not limited to a combination of check valves 7 as shown in these examples. As long as the air-flow between the first compartment 21 and the second compartment 22 passes with resistance, any other means may be employed such as making the passage narrower, or disposing fiber or other materials inside the passage.

By thus forming the air-flow passage between the first compartments 21*l*, 21*r* and the second compartments 22*l*, 22*r*, an air-flow from either of the first compartments 21*l*, 21*r* and the second compartments 22*l*, 22*r* to the other, as caused by an impact in falling or the like, can pass quickly while an air-flow in the reverse direction can be checked. This may prevent the compartment 2 accepting the impact from rupture which would happen by reason that there is no way out for the air in the compartment, or prevent the article A to be protected from damage due to wild bounding on the floor or ground.

The cushion check valve 7 used in this embodiment is same as the inlet side check valve 6, made of a small piece of soft resin sheet with both ends being open in a flat tubular shape, allowing an air-flow to pass from one end thereof to the other, checking an air-flow in the reverse direction.

In the cushion check valve 7, as shown in FIGS. 2(A) and 2(B), a valve air passage 73 between the two passage sheets 72, 72, can be checked by a valve sheet 74 which is adhered to one of the passage sheets 72, 72 on one side and movable on the other side. Or, as shown in FIG. 2(C), the passage sheets 72, 72 are adhered by a spot seal 75 producing in the valve air passage 73 resistance that is, as compared with the air-flow F in the direction of an arrow, set larger against the passing air-flow in the reverse direction, thus the air-flow F may pass more smoothly. The cushion check valve 7 is not limited to these examples, but may employ various forms.

With provision of the cushion check valve 7, while resistance to the passing air-flow from the second compartment 22 to the first compartment 21 is set larger than that from the first compartment 21 to the second compartment 22 at the right side check valve 7*r*, resistance to the passing air-flow from the first compartment 21 to the second compartment 22 is set larger than that from the second compartment 22 to the first compartment 21 at the left side check valve 71. As a result, an air-flow from either of the first compartment 21 and the second compartment 22, where the relatively small passing resistance is applied, can pass quickly, while an air-flow in the reverse direction, where the relatively large passing resistance is applied, can be checked. Accordingly, the air-flow passes with certain resistance through the cushion check valve 7, as compared with the case where a portion between the compartments 21 and 22 is fully open. Even one of the first compartment 21 and the second compartment 22 accepts an impact, an air will not move so quickly and direct hitting of the article A on the floor or ground will not happen, resulting in no damage to the article A. Meanwhile, it is effective for the compartment 2 which accepts an impact to prevent it from rupture which would happen by reason that there is no way out for the air in the compartment. And the article A may avoid damage due to wild bounding on the floor or ground.

After the impact, the air moves as mentioned above, and the state concerning air between the first compartment 21 and the second compartment 22 is not balanced. But the air slowly passes through the cushion check valve 7 afterwards, and a balanced state is restored.

The inlet side check valve 6 and the cushion check valve 7, both of which can be made open from outside the air-filled cushioning material 1, a slide fastener or other opening and closing means may be employed to supply and/or discharge air in each compartment 2. Thus, only the necessary compartment 2 can be inflated. Or the air can be discharged from the compartment area 2 after the air-filled cushioning material 1 is used to reduce its volume, and the air may be supplied again for reuse.

Also, in order to reduce the volume of the compartment area 2 easily after it is used, a notch may be partially provided in the air-filled cushioning material 1 to tear it for discarding, or an easy-detachable flap may be provided at an air-discharging portion to let it open.

The air-filled cushioning material 1 having such structure can be processed in various forms when putting in actual use. With the compartment area 2 inflated, the air-filled cushioning material 1 shown in FIG. 1 may be used as a flat cushioning member or may turn into a cubiform cushioning material 8 having a containing space 81 thereinside.

FIG. 3 shows an example of actual use of a cubiform cushioning material 8. The flat air-filled cushioning material 1 shown in FIG. 1 is folded in two along the vertical partition seal 4*b*, and the overlapped right and left sides are bonded by thermal compression or the like. Thus, a space 81 is formed as being surrounded by the air-filled compartment area 2. An article A contained in the space 81 as shown in FIG. 4 is enveloped by the compartment area 2.

In a different example in FIG. 5, two vertical partition seals 4*b* are formed so as to interpose the air inlet portion 5. By folding along the respective vertical partition seals 4*b*, the air inlet portion 5 may become the width of the cubiform cushioning material 8 to cope with an article A having a certain thickness.

As shown in FIG. 4(B), when the cubiform cushioning material 8 containing an articles A falls with the second compartment 22 down on the floor or ground, the second compartment 22 is compressed by the falling impact.

Conventionally, when a portion between the first compartment 21 and the second compartment 22 is fully open, the compressed air in the second compartment 22 quickly moves into the first compartment 21 and the article A hits the floor or ground, getting damaged. On the other hand, when a portion between the first compartment 21 and the second compartment 22 is closed, the compressed air in the second compartment is unable to find a way out and may result in rupture of the second compartment 22, or the cubiform cushioning material 8 may bound wildly on the floor or ground to damage the article A.

In this embodiment, however, the compressed air in the second compartment 22 moves into the first compartment 21 through the left side check valve 71 of the cushion check valve 7. Since the provision of the cushion check valve 7 makes narrow between the compartments 21 and 22, as compared with the case where it is fully open, resulting in producing resistance, the air-flow does not move away quickly and it prevents the article A from hitting and damage.

The mode of the compartment 2 in the present invention is not limited to the example illustrated here, but may be changed and modified in various forms.

In the example shown in FIG. 4, when the cubiform cushioning material 8 touches the floor, the compressed air in the second compartment 22 existing in the side facing the floor flows into the first compartment 21 at the opposite side. The compartment area 2 may be divided in order that the air may move within the same side facing the floor.

In the example, the compartment where the air moves away correspondent to the compartment where the air moves into as one to one. One compartment may correspond to other plural compartments, for example, one compartment where the air moves away may be enclosed by two compartments where the air moves into.

As shown in FIG. 5, a spot seal 9 may be provided in the compartment area 2. Where the spot seal 9 is provided may not inflate when the compartment are 2 is filled with air. This makes the surface of the compartment area 2 uneven, providing a cubiform cushioning material 8 that fits the configuration of the article A.

Also, when the air inlet portion 5 is formed between the first compartment 21 and the second compartment as shown in FIG. 5, an inlet side check valve 6 may be provided in the first compartment 21, as indicated by dotted line in FIG. 5, without forming it in the air inlet portion 5, leaving the air inlet portion 5 as a portion for the air passing through the cushion check valve 7 and the width of the cubiform cushioning material 8.

In the present invention, with either of the compartments accepting an external force, the air in the compartment can move into one of the other compartments through the air-flow passage, thereby avoiding rupture of the sheet of the compartment area or damage of an article to be protected in contact with the compartment area due to wild bounding in falling on the floor or ground.

In the aspect of the present invention as defined in claim 2, a cubiform cushioning material is formed to have a containing space thereinside, and the article in the space can be protected effectively.

In the aspects of the present invention as defined in claims 3 and 4, the first air-flow passage (check valve) is formed in order that resistance to the passing air-flow from the second compartment to the first compartment may be larger than that from the first compartment to the second compartment, while the second air-flow passage (check valve) is formed in order that resistance to the passing air-flow from the first compartment to the second compartment may be larger than that from the second compartment to the first compartment. Since the air passes with resistance through the cushion check valve, as compared with the case where a portion between the compartments is fully open, the air in the compartment will not move so quickly and direct hitting of the article A on the floor or ground will not happen, resulting in no damage to the article A. Meanwhile, it is effective for the compartment which accepts an impact to prevent it from rupture which would happen by reason that there is no way out for the air in the compartment. And the article A may avoid damage due to wild bounding on the floor or ground.

In the aspect of the present invention as defined in claims 5 to 7, the compartments can be effectively filled with air through the air inlet portion.

The invention being thus described, it will be obvious that the same may be varied in many ways. Such variations are not to be regarded as a departure from the spirit and scope of the invention, and all such modifications as would be obvious to one skilled in the art are intended to be included within he scope of the following claims.

DESCRIPTION OF THE REFERENCE NUMERALS

1 Air-filled cushioning material, flat cushioning material
2 Compartment (area)
21 First compartment
22 Second compartment
5 Air inlet portion
6 Inlet side check valve
7 Air-flow passage, cushion check valve
**7*r*** First air-flow passage, right side check valve
**7*l*** Second air-flow passage, left side check valve
8 Cubiform cushioning material
81 Space (for containing an article)
A Article to be protected
P External force

What is claimed is:

1. An air-filled cushioning material formed by sealing part of non-breathable soft resin sheets and having a compartment area that produces cushioning effect by filling with air thereinside, wherein said compartment area is separated into a first compartment and an adjacent second compartment, both compartments communicating with each other via an air-flow passage, and said air-flow passage allows an air-flow to pass from either of the compartments to the other while applying resistance, and through which the air in either of the compartments which accepts an external force moves to the other compartments, wherein the air-flow passage is composed of a first air-flow passage and a second air-flow passage disposed parallel to each other, and said first air-flow passage is formed in order that resistance of the passing air-flow from the second compartment to the first compartment may be larger than from the first compartment to the second compartment, and said second air-flow passage is formed in order that resistance of the passing air-flow from the first compartment to the second compartment may be larger than that from the second compartment to the first compartment.

2. The air-filled cushioning material as defined in claim 1, wherein the air-flow passage is a check valve.

3. An air-filled cushioning material as a cubiform cushioning material having a space for containing an article to be protected, the space formed by folding and sealing part of a flat cushioning material which is formed by sealing part of non-breathable soft resin sheets and has a compartment area that produces cushioning effect by filling with air thereinside, wherein said compartment is separated a first compartment and an adjacent second compartment, both compartments communicating with each other via an air-flow passage, and said air-flow passage allows an air-flow to pass from either of the compartments to other while applying resistance, and through which the air in either of the compartments which accepts an external force moves to the other compartments, thereby protecting the article, wherein the air-flow passage is composed of a first air-flow passage and a second air-flow passage disposed parallel to each other, and said first air-flow passage is formed in order that resistance of the passing air-flow from the second compartment to the first compartment may be larger than from the first compartment to the second compartment, and said second air-flow passage is formed in order that resistance of the passing air-flow from the first compartment to the second compartment may be larger than that from the second compartment to the first compartment.

4. The air-filled cushioning material as defined in claim 3, wherein the air-flow passage is a check valve.

5. An air-filled cushioning material formed by sealing part of non-breathable soft resin sheets, comprising a first compartment that produce cushioning effect by filling with air thereinside;

a second compartment, same as the first compartment, that is adjacent to the first compartment and communicates with the first compartment directly or indirectly;

an air inlet portion for passing air to fill in the compartments;

an inlet side check valve for preventing the air filled in the compartments from leaking outside of the air-filled cushioning material; and cushion check valves disposed where the first compartment and the second compartment communicate in order to pass the air-flow from either of the compartments to other while applying resistance, wherein the cushion check valves are composed of a first check valve and a second check valve disposed parallel to each other, and said first check valve is formed in order that resistance of the passing air-flow from the second compartment to the first compartment may be larger than from the first compartment to the second compartment, and said second check valve is formed in order that resistance of the passing air-flow from the first compartment to the second compartment may be larger than that from the second compartment to the first compartment.

6. The air-filled cushioning material as defined in claim 5, wherein said air inlet portion, said first compartment and said second compartment are sequentially and adjacently disposed to each other, and said inlet side check valve is provided at the boundary of the air inlet portion and first compartment, and said cushioning check valves are provided at the boundary of the first compartment and second compartment.

7. The air-filled cushioning material as defined in claim 5, wherein the first compartment, the air inlet portion, and the second compartment are sequentially and adjacently disposed to each other, and the inlet side check valve is provided at the boundary of the air inlet portion and outside of the air-filled cushioning material, and the cushioning check valves are provided at the boundary of the air inlet portion and first compartment, and at the boundary of the air inlet portion and the second compartment.

* * * * *